US005131442A

United States Patent [19]

Bevier

[11] Patent Number: 5,131,442

[45] Date of Patent: Jul. 21, 1992

[54] GOLF BAG COVER FOR PROTECTING CLUBS

[76] Inventor: Louis W. Bevier, 341 Nayatt Rd., Barrington, R.I. 02806

[21] Appl. No.: 696,984

[22] Filed: May 2, 1991

Related U.S. Application Data

[63] Continuation of Ser. No. 558,752, Jul. 27, 1990, abandoned.

[51] Int. Cl.[5] ..... A63B 55/00

[52] U.S. Cl. ..... 150/159; 206/315.4

[58] Field of Search ..... 150/159, 160; 206/315.2-315.7; 280/DIG. 6

[56] References Cited

U.S. PATENT DOCUMENTS

| | | | |
|---|---|---|---|
| D. 256,293 | 2/1980 | Edwards | 206/315.4 X |
| 2,704,563 | 3/1955 | Henrich | 206/315.4 |
| 2,907,364 | 10/1959 | Trenery | 150/159 |
| 3,620,276 | 11/1971 | Taylor | 150/159 |
| 3,754,587 | 8/1973 | Rainieri | 150/159 |
| 3,913,648 | 10/1975 | Sessler | 150/160 X |
| 4,200,133 | 4/1980 | Whitlow | 150/159 |
| 4,234,025 | 11/1980 | Berge | 150/160 X |
| 4,453,632 | 6/1984 | Clower | 150/160 X |
| 4,498,579 | 2/1985 | Brick | 206/315.4 |
| 4,752,004 | 6/1988 | Very | 150/159 |

FOREIGN PATENT DOCUMENTS

| | | | |
|---|---|---|---|
| 1230580 | 5/1971 | United Kingdom | 206/315.3 |

*Primary Examiner*—Sue A. Weaver

*Attorney, Agent, or Firm*—Watts, Hoffmann, Fisher & Heinke Co.

[57] ABSTRACT

A golf bag rain cover composed of waterproof plastic material having a flap to which a golf scorecard pocket is sealed; the flap extends across the top opening and is sealed on both ends. A drawstring along the bottom is placed under the golf bag strap ring on one side and can be pulled tight and held fast with a cord-locking device on the other. This invention protects the clubs and scorecard from inclement weather while allowing easy access to them and a positive attachment of the cover to the bag.

12 Claims, 4 Drawing Sheets

GOLF BAG COVER FOR PROTECTING CLUBS

This is a continuation of copending application Ser. No. 07/558,752 filed on Jul. 27, 1990 now abandoned.

BACKGROUND OF THE INVENTION

This invention concerns a cover for a golf bag to protect the clubs in the bag from inclement weather.

BACKGROUND ART

Many types of covers known in the prior art are designed to protect golf clubs from inclement weather. There are various ways of closing these covers to prevent rain from getting on the clubs. There are also many ways of attaching the covers to the golf bags.

U.S. Pat. No. 4,200,133 to Whitlow (1980) discloses an elongated sleevelike cover having a top opening. The sleeve folds over during transportation of the clubs. However, for this to take place, the cover becomes too long to use easily. It is difficult to take a club out of the bag without pulling the cover off the bag. If the cover is made short enough to be manageable it does not fold over so water can enter the golf bag during transportation.

U.S. Pat. No. 4,752,004 to Very (1988) discloses a cover having small slit openings and a short, tight skirt that make it difficult to remove or replace clubs. A belt arrangement for attaching the cover to the bag interferes with the use of the golf bag strap. There is no positive attachment to prevent the cover from coming off if the belt loosens.

U.S. Pat. No. 4,498,579 to Brick (1985) discloses a cover that utilizes a zipper, a hook or Velcro TM type fasteners that are cumbersome in use. Because of their inconvenient use, the closures are often left open during play which allows rain to enter the bag.

Because it covers the entire bag, the cover shown in U.S. Pat. No. 3,754,587 to Rainieri (1973) will not pull off. However, this cover is not easily put on the bag and once it is taken off the bag it is bulky to store.

The cover in U.S. Pat. No. 3,620,276 to Taylor (1971) has a positive means of holding it onto the bag. However, it is designed for use on a pull golf cart only which limits its applications.

The golf bag rain covers known to applicant suffer from a number of disadvantages:

(a) The opening at the top is not large enough to easily remove and replace the clubs.

(b) The flap at the top is too short to protect the clubs or is too tight to allow them to be easily removed.

(c) The opening at the top is not closed so wind will cause rain to be blown into the cover and then into the golf bag.

(d) The flap at the top has to be closed with a zipper or hook and loop type fastener which is awkward to use. Often it is not closed properly during play which allows rain to enter.

(e) No way of keeping a golf scorecard handy, dry and visible while playing is provided.

(f) Methods of attaching the cover to the bag are not usable when carrying the bag, pulling it on a hand cart, or using it on a motorized cart.

(g) There is no space provided where logos readily can be screen printed on an opaque surface for advertising purposes without interfering with the ability to see the clubs.

Because of the deficiencies of the golf bag covers available, there is a need for a durable cover with the following features:

(a) A cover that will stay on the bag when in use and will protect the clubs while the golfer is playing or transporting the clubs.

(b) A cover that will allow easy access to the bag so the clubs can be seen for selection and readily removed and replaced without using zippers or other closures.

(c) A cover that can be used whether the golfer carries his/her bag, pulls a hand cart, or rides on a motorized cart.

(d) Because golf bag covers are used as advertising specialty items, a cover that has a space for screen printing but still provides good visibility of the clubs.

(e) Because paper golf score cards are used during play, a cover that has a place to keep a score card dry, visible and readily accessible.

DISCLOSURE OF THE INVENTION

A golf bag cover constructed in accordance with the invention protects golf clubs from inclement weather. The cover is constructed using two pieces of clear flexible plastic material of equal widths and different lengths connected on both sides with their bottom edges aligned. A third piece of clear flexible plastic material has the same width as the first two pieces and a length greater than the difference in length between the first two pieces. The third piece is connected along the top edge of the longer of the first two pieces to overlap the top edge of the shorter of the first two pieces. The first two pieces are securely attached along a bottom edge to the top of a golf bag.

A golf bag cover so constructed provides an inexpensive, easily manufactured cover to protect golf clubs and a golf scorecard from inclement weather.

The flap formed by the third piece of plastic material will stay in place when clubs are transported. The clubs can be easily removed or replaced during play by lifting the flap. The cover will stay on the bag when in use but is easily removed and stored in the golf bag. An opaque piece attached to the bottom of the cover provides a convenient space for screen-printing advertising information. This piece includes a drawstring arrangement for attaching the cover to the golf bag by means of a locking device.

Accordingly, several objects and advantages of my invention are:

(a) The opening across the cover's top is wide enough to easily remove and replace the clubs.

(b) The top flap is long enough to form a cap to protect the clubs from rain when removing or replacing them.

(c) The flap is attached on each end to prevent it from opening when the clubs are being transported or to open too wide when the clubs are being removed or replaced.

(d) The clear plastic material allows all clubs to be seen when selection is being made.

(e) The flexible opaque piece on the bottom gives strength to the cover and provides a space for attractively printing silk-screen logos or other advertising information. Because it is at the bottom of the cover, it does not interfere with the visibility of the clubs.

(f) The drawstring arrangement for attaching the cover to the bag is placed under the golf bag hook ring to provide a positive attachment whether the bag is being carried, pulled on a hand cart, or used on a motorized cart.

(g) The cord-locking device positively holds the drawstring tightly around the bag to securely hold the cover on the bag.

(h) The use of reinforcing snaplocks provide additional strength to the heat-sealed seams on the edges of the cover to make them more durable.

(i) A scorecard pocket provides a place to keep a scorecard dry, visible, and easily accessible.

(j) The construction from flexible plastic with heat-sealed seams allows the cover to be easily folded and kept in the side pocket of the golf bag.

(k) Although available on some prior bag covers, slits to accept the golf bag ring and still use the drawstring arrangement provides further flexibility for the use of the cover.

Further objects and advantages will become apparent from a consideration of the ensuing description and drawings.

BEST MODE FOR PRACTICING THE INVENTION

Figure 1:
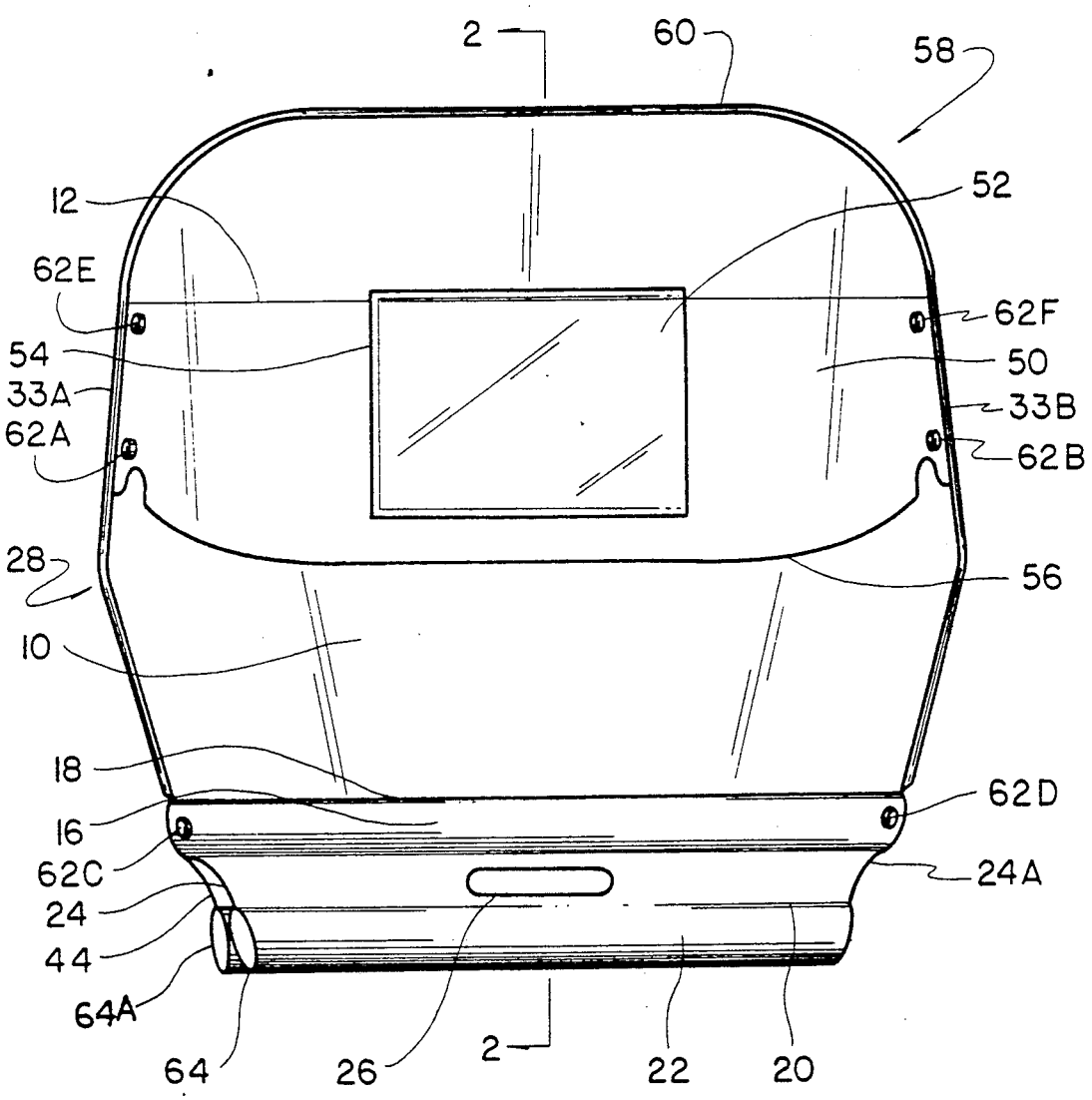
FIG. 1 is an elevation view of a golf bag cover constructed in accordance with the invention.
Figure 2:
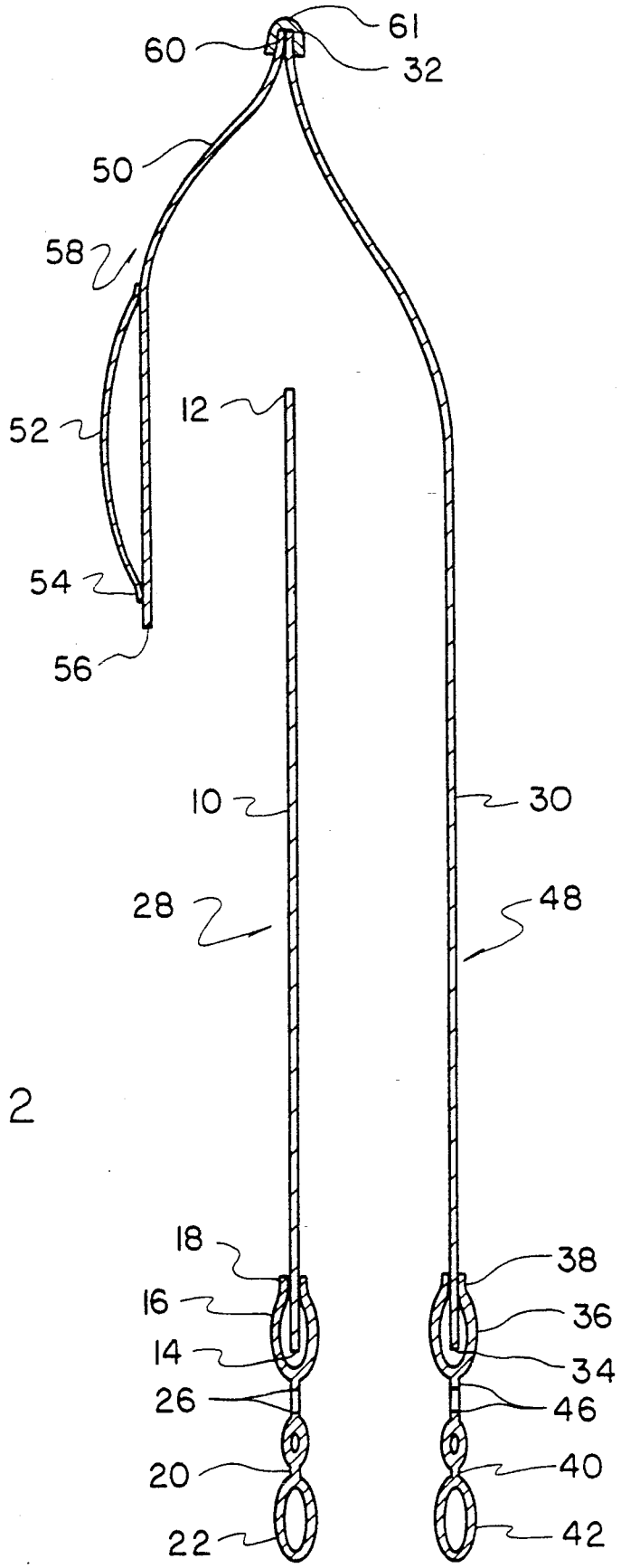
FIG. 2 is a cross-sectional view taken along lines 2—2 of FIG. 1.

Turning now to the drawings, FIGS. 1 and 2 show a preferred embodiment of a golf bag cover constructed in accordance with the present invention. A front piece 10 of clear flexible plastic has a top edge 12 and a bottom edge 14 (see FIG. 2). An opaque piece 16 of flexible plastic is heatsealed to the front piece 10 along inner and outer surfaces at a region 18 spaced from the bottom edge 14. The opaque piece 16 is heatsealed along a region 20 to itself to form a front hem 22. At the time the front hem is formed, a bartearseal forms two ring cutout seals 24, 24A and another bartearseal forms a slot seal 26. This produces front assembly 28.

In FIG. 2 a back piece 30 consists of a similar sheet of clear flexible plastic of the same width as piece 10. The piece 30 has a greater length but the bottom edge 34 of piece 30 is in the same location as edge 14. A back opaque piece 36 of flexible plastic is heatsealed to the back piece 30 along inner and outer surfaces at a region 38 spaced from the bottom edge 34. The back opaque piece 36 is heatsealed along a region 40 to form a back hem 42. At the same time, a bartearseal forms back ring cutout seals 44 and 44A and another bartearseal forms a ring slot seal 46. This produces a back assembly 48.

The front piece 10 as seen in FIG. 1 (and corresponding back piece 30) are generally six-sided figures. The back piece 30 defines a rounded transition from a top edge 32 to two inwardly tapered side edges. The top 12 of the front piece 10 has the inwardly tapered sides 33A, 33B. Front piece 10 and back piece 30 are wider at their middle and taper inward towards top and bottom edges.

In FIGS. 1 and 2 a front flap 50 is formed from a sheet of similar clear flexible plastic of the same width as piece 10 and piece 30. The length of flap 50 is approximately twice the difference between the length of piece 30 and piece 10. A piece of the same material is die cut to form a scorecard pocket 52. The pocket 52 is heat-sealed along a region 54 that extends on one end and the top and bottom of the flap 50. As seen in FIG. 1 the flap 50 has a greater length in the middle than at the ends. These operations produce flap assembly 58.

Front assembly 28 is placed on top of back assembly 48 so that the heat seals 18, 38 and bartearseals 24, 44 line up. Flap assembly 58 is centered on top. These three assemblies are then heatsealed along a bartearseal assembly line 60 from a top of the cutout 24 to a top of the cutout 24A. At the same time, six heatsealed holes 62A–F positioned at stress points where the seal 60 is most likely to tear are produced. The excess plastic outside of bartearseal 60 is removed by trimming. The corners of hems 22, 42 are die cut to open the hems and form hem cuts 64, 64A. The width of the front and back pieces 10, 30 in the region of the front and back opaque pieces 16, 36 is sufficient to form an opening in the cover that accommodates the golf bag.

Figure 3:
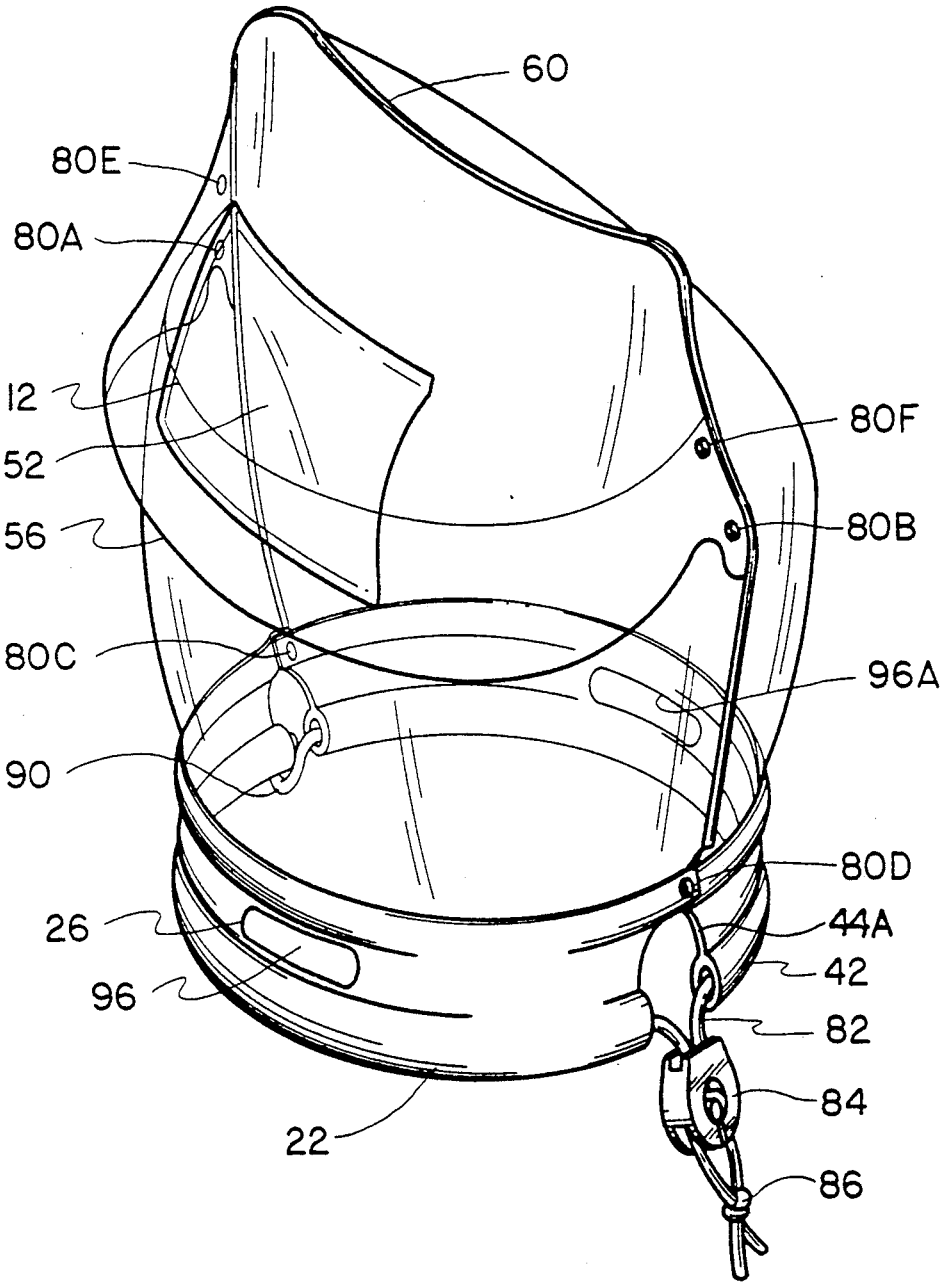
FIG. 3 is a perspective view of the cover depicted in FIG. 1 depicting use of a locking device for securing a drawstring.
Figure 4:
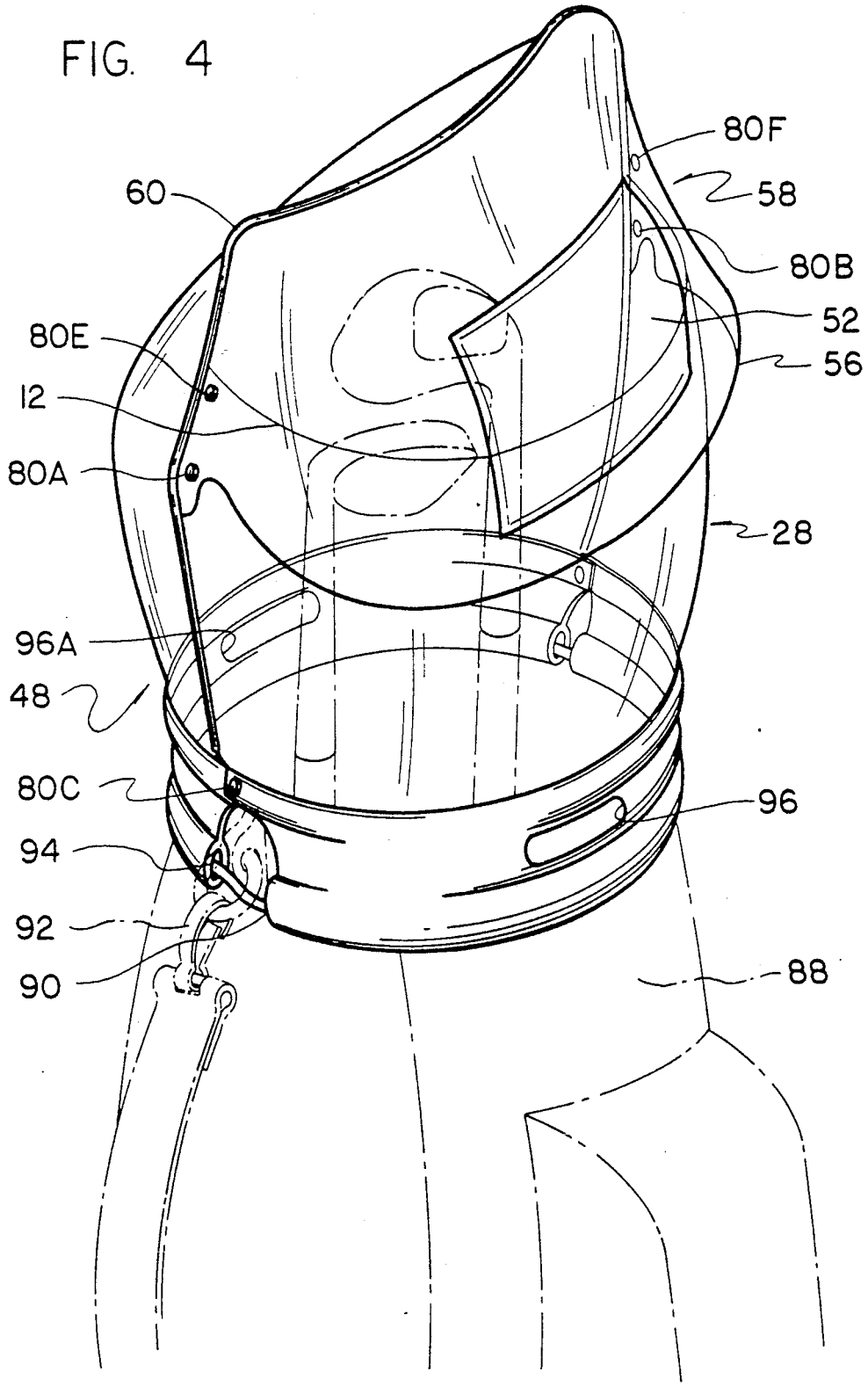
FIG. 4 is a perspective view of the golf bag cover on a visible portion of a golf bag showing the drawstring positioned underneath a golf bag ring.

FIGS. 3 and 4 show the completed golf bag cover of the invention. A drawstring 82 consisting of a length of braided cord is inserted into the right end of hem 42 and pushed through hem 42. The end of drawstring 82 is reinserted in the left end of hem 22 and pulled through hem 22. The ends of drawstring 82 are fed through a cord-locking device 84 (commercially available under the designation Wheel Lock WL 194, American Cord and Webbing, Woonsocket, R.I. 02895) and tied together to form a drawstring knot 86. Six snaplocks 80 A–F (commercially available from Rau Fastener, Providence, R.I. 02903) are secured through holes 60 A–F shown in FIG. 1.

Operation

To use this invention, the cover is placed over the golf clubs while they are in the golf bag 88. Golf bag strap hook 92 is removed from golf bag strap ring 94 and the closed end of drawstring 90 is placed under ring 94. Hook 92 is then reconnected to ring 94. The cover also may be attached by turning the cover 90 degrees. Ring 94 can be positioned through ring slot 96 or 96A and hook 92 reconnected. The golfer's preference, the type and size of golf bag, and whether the bag is to be carried, pulled on a cart, or used on a motorized cart will determine the method used. Drawstring 82 is then pulled tightly through device 84 to hold the cover securely on bag 88.

Because the plastic is clear, clubs can be selected without opening the cover. Edge 56 is raised enough to remove the desired club from the bag. The contour on edge 56 forms a cap over the opening to protect the other clubs. After returning the club to the bag in the same manner, edge 56 stays down over edge 12 to protect clubs while they are being transported or during play of the game. Because flap 50 is sealed along seam 60 to edge 56, it will be held down against the wind. However, the opening provided along the entire length of edge 12 allows the clubs to be easily removed or replaced. After use, the cover can be folded and replaced in the golf bag.

Alternative methods of production are available:

a. Pieces may be die cut and sewn around heat seal assembly line 60 using a fabric or plastic binding 61. This adds costs to the product and makes it more bulky to fold and store.

b. The front and back pieces may be made longer, folded on themselves and heatsealed along seals 18 and 20 and 38 and 40. This is less expensive but has less strength and does not provide a space for advertising printing.

c. An elastic material having a length less than twice the width of the cover can be attached to the base of the cover. This continuous band then resistantly retains the cover on the golf bag by engaging the outer surface thereof adjacent to the top of the bag. This arrangement is not as positive as the drawstring method of this invention.

d. Advertising logos or other printed material can be placed on the opaque material.

While the above description contains many specifics, these should not be construed as limitations on the scope of the invention but rather exemplification of one preferred embodiment thereof. Many other variations are possible:

a. Different types and thicknesses of clear plastic material can be used. Representative choices are vinyl, polyethylene or polypropylene of approximately 0.006 inch thickness.

b. The shape and size of the flap can be changed.

c. The location of the scorecard pocket can be altered.

d. Different sizes and types of opaque plastic can be used.

e. Different types of reinforcing along the sides of the cover can be used.

f. Different drawstring materials and cord-locking devices can be used.

g. The configuration of the bottom of the bag and ring cutouts can be altered.

h. An elastic material on the bottom along with the ring slot can be used instead of the drawstring.

Accordingly, the scope of the invention should be determined not by the embodiments illustrated. It is the intent that the invention encompass all alterations or modifications from the disclosed design falling within the spirit or scope of the appended claims.

I claim:

1. A golf bag cover for protecting golf clubs from inclement weather comprising:

a. two pieces of clear flexible plastic material of equal widths and different lengths connected along their side edges and having their bottom edges aligned;

b. a third piece of clear flexible plastic material having the same width as the first two pieces and having a length greater than the difference in length between the first two pieces; the third piece sealed along top and side edges of a longer of the first two pieces at least as far as a top edge of a shorter of the first two pieces to inhibit precipitation from entering a region between said two pieces; and c. attaching means coupled to the first two pieces for holding a bottom of the golf bag cover to the top of a golf bag.

2. The golf bag cover of claim 1 wherein the three pieces of clear flexible material are heatsealed along their edges.

3. The golf bag cover of claim 2 further comprising snaplocks at stress points along the edges of the three pieces of plastic material.

4. The golf bag cover of claim 1 further comprising a small piece of clear flexible plastic material sealed to one of the three pieces to form a pocket for a golf scorecard.

5. The golf bag cover of claim 1 wherein the third piece is contoured to make it longer in the center than at the side edges.

6. The cover of claim 1 wherein the two pieces of clear flexible plastic material are wider at their middle and taper inward toward top and bottom edges.

7. The golf bag cover of claim 1 wherein a pieces of opaque plastic material is folded over and sealed to the bottom of each of the first two pieces to provide a hem for a drawstring for holding the cover securely to a golf bag.

8. The golf bag cover of claim 1 additionally comprising binding means for strengthening an engagement between at least two of the pieces of clear flexible plastic material.

9. A golf bag cover for protecting golf clubs from inclement weather comprising:

(a) two pieces of clear flexible plastic material of equal widths and different lengths heatsealed along their side edges and having their bottom edges aligned;

(b) a third piece of clear flexible plastic material having the same width as the first two pieces and having a length grater than the difference in length between the first two pieces; the third piece heatsealed along a top edge of a longer of the first two pieces to overlap a top edge of a shorter of the first two pieces;

(c) attaching means coupled to the first two pieces for holding a bottom of the golf bag cover to the top of a golf bag; and, (d) snaplocks at stress points along the edges of the three pieces of plastic material.

10. A golf bag cover for protecting golf clubs from inclement weather comprising:

(a) two pieces of clear flexible plastic material of equal widths and different lengths that are both wider at their middle and taper inwardly toward top and bottom edges connected along their side edges and having their bottom edges aligned;

(b) a third piece of clear flexible plastic material having the same width as the first two pieces and having a length greater than the difference in length between the first two pieces; the third piece connected along a top edge of a longer of the first two pieces to overlap a top edge of a shorter of the first two pieces; and, (c) attaching means coupled to the first two pieces for holding a bottom of the golf bag cover to the top of a golf bag.

11. A golf bag cover for protecting golf clubs from inclement weather comprising:

(a) two pieces of clear flexible plastic material of equal widths and different lengths connected along their side edges and having their bottom edges aligned;

(b) a third piece of clear flexible plastic material having the same width as the first two pieces and having a length greater than the difference in length between the first two pieces; the third piece connected along a top edge of a longer of the first two pieces to overlap a top edge of a shorter of the first two pieces; and, (c) a piece of opaque material folder over and sealed to the bottom of each of the first two pieces to provide a hem for a drawstring for holding the cover securely to a golf bag.

12. The golf bag cover of claim 11 wherein a slit is heatsealed into the opaque plastic material to accept a golf strap ring.

* * * * *